United States Patent [19]

Mailloux

[11] 4,264,793

[45] Apr. 28, 1981

[54] MACHINE DOOR CLOSURE SAFETY CONTROL APPARATUS

[75] Inventor: Armand R. Mailloux, Roxbury, Conn.

[73] Assignee: Pitney Bowes Inc., Stamford, Conn.

[21] Appl. No.: 42,274

[22] Filed: May 24, 1979

[51] Int. Cl.[3] ..... H01H 3/16

[52] U.S. Cl. ..... 200/61.62; 200/61.7

[58] Field of Search ..... 200/50 A, 61.42, 61.62, 200/61.63, 61.7, 153 T, 330, 61.43

[56] References Cited

U.S. PATENT DOCUMENTS

| | | | |
|---|---|---|---|
| 2,421,709 | 6/1947 | Miller | 200/61.7 X |
| 2,771,526 | 11/1956 | Claras et al. | 200/61.62 |
| 3,384,722 | 5/1968 | Hanke et al. | 200/50 A |
| 3,504,144 | 3/1970 | Horner | 200/61.62 |
| 3,602,662 | 8/1971 | Haller | 200/61.62 |
| 3,689,718 | 9/1972 | Gorsuch | 200/61.62 |
| 4,201,901 | 5/1980 | Schuchert | 200/153 T X |

FOREIGN PATENT DOCUMENTS

| | | | |
|---|---|---|---|
| 1118532 | 7/1968 | United Kingdom | 200/61.62 |

*Primary Examiner*—James R. Scott

*Attorney, Agent, or Firm*—Donald P. Walker; William D. Soltow, Jr.; Albert W. Scribner

[57] ABSTRACT

In a machine which includes a motor and a housing, and wherein the machine is adapted to be connected to a source of supply of power for energizing the motor, and the housing has an opening formed therein and a door pivotably movable between a closed position and an opened position for respectively covering and uncovering the opening, there is provided safety control apparatus including a manually inaccessibly mounted switch which is operable in a power-on mode permitting motor energization and a power-off mode preventing motor energization. The safety apparatus also includes an actuator which is pivotably attached to the housing and disposed in engagement with the switch, and includes a cam follower movable between a first position, wherein the actuator is disposed for operation of the switch in its power-on mode, and a second position, wherein the actuator is disposed for operation of the switch in its power-off mode.

6 Claims, 4 Drawing Figures

MACHINE DOOR CLOSURE SAFETY CONTROL APPARATUS

BACKGROUND OF THE INVENTION

In machines of the type which include a motor adapted to be connected to a source of supply of power, and include a housing having a manually accessible opening formed therein for access into the interior of the housing to, for example, make adjustments or repair instrumentalities within the housing; it is the usual practise to provide safety control apparatus, operable in connection with an access door for covering and uncovering the opening, to automatically deenergize the motor when the door is opened. To guard against inadvertent operation of such safety control apparatus it has been suggested in U.S. Pat. No. 3,602,662, issued Aug. 31, 1971, to Haller, that there be provided structure requiring the operator to perform a function other than opening or closing the door to guard against inadvertent operation of, for example, a washing machine. The complexity of the solution offered in the Haller patent not only increases the cost of manufacture of the machine to which it is applied, but adds additional structure subject to breakdown, thus raising the cost of maintenance of the machine.

Accordingly, an object of the present invention is to provide a simplified structure for automatically deenergizing the motor of a machine when a manual access door is opened; and Another object is to provide improved safety control apparatus in a machine having a manually accessible opening and a door for covering and uncovering the opening.

SUMMARY OF THE INVENTION

In a machine which includes a motor adapted to be connected to a source of supply of power for energizing the motor, and includes a housing having a manually accessible opening formed therein and includes a door pivotably movable between a closed position covering the opening and an opened position uncovering the opening, there is provided safety control apparatus comprising switching means manually inaccessibly mounted with the housing and operable in a power-on mode permitting motor energization and a power-off mode preventing motor energization. To operate the switching means there is provided actuating means pivotably attached to the housing and disposed in engagement with the switching means. The actuating means includes a cam follower movable between a first position, wherein the actuating means is disposed for operation of the switching means in the power-on mode, and a second position, wherein the actuating means is disposed for operation of the switching means in the power-off mode. In addition, the apparatus includes a bracket fixedly attached to the door for movement therewith. The bracket includes a substantially L-shaped aperture for receiving therein in sliding engagement therewith the cam follower. One leg of the aperture adapts the bracket for precipitously camming the cam follower from its first position to its second position in response to initial opening movement of the door, and the other leg arcuately-extends from the first leg to adapt the bracket for maintaining the cam follower in the second position against inadvertent manual movement as the door is moved to and from its opened position and until the door is thereafter closed.

BRIEF DESCRIPTION OF THE DRAWINGS

As shown in the drawings, wherein like reference numerals designate like or corresponding parts throughout the several figures.

DESCRIPTION OF THE PREFERRED EMBODIMENT

Figure 1:
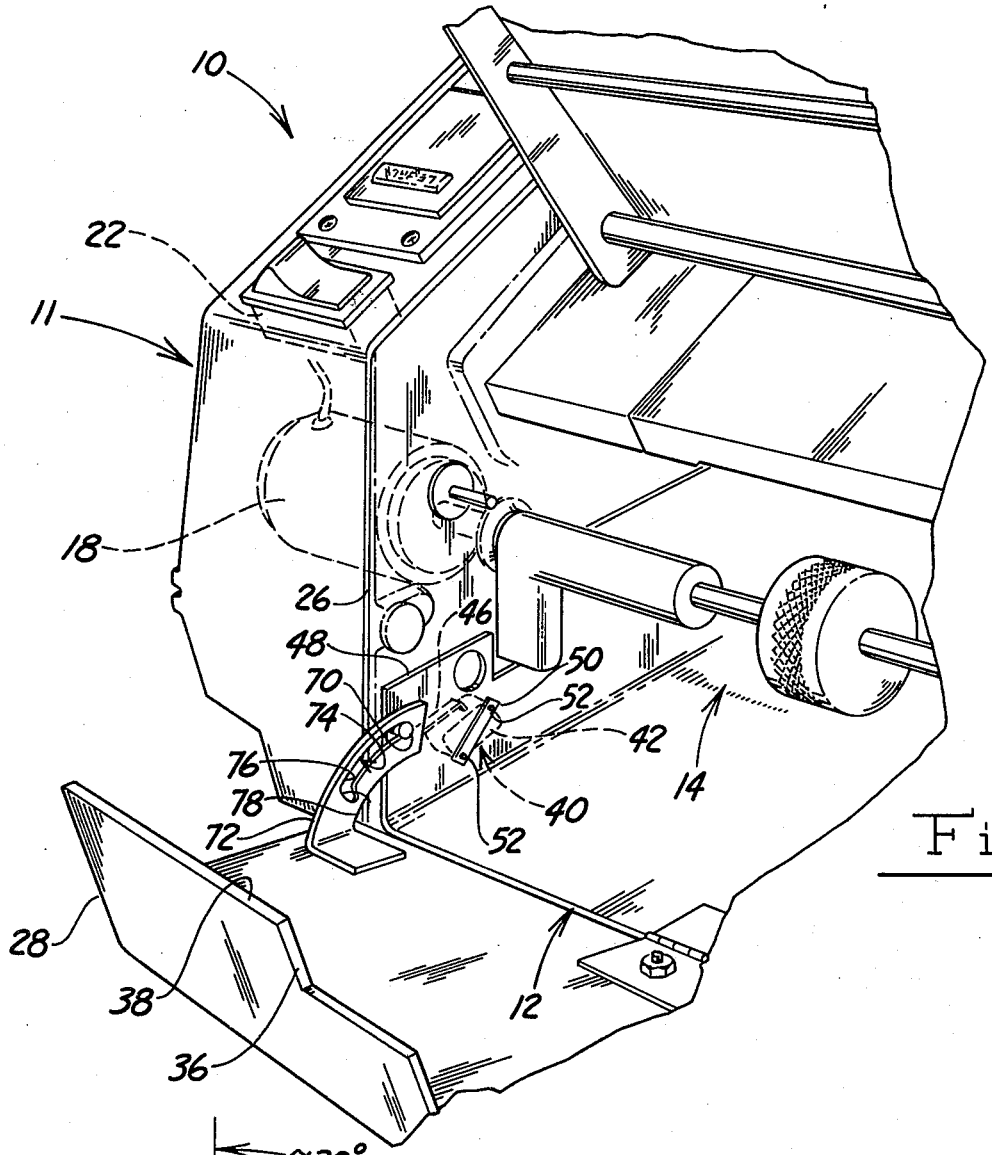
FIG. 1 is a fragmentary perspective view of a machine including the safety control apparatus according to the invention.

As shown in FIG. 1, a machine 10 of the type which may be improved in accordance with the present invention, generally comprises a housing 11 including framework 12 for supporting the various components of the machine 10 including electro-mechanically operated instrumentalities, partially shown at 14, for performing the various functions of the machine 10. For operating the machine 10, there is provided suitable circuitry, partially shown at 16 (FIG. 4), including a motor 18 connected by well-known means to a source of supply of power 20 for energizing the motor 18 and thus the machine 10. In addition, the circuitry 16 includes a conventional, manually-operable power line switch 22; and may also include a suitable normally-closed thermal trip switch 24 connected in series with the line switch 22 for disabling the machine 10 on the occurrence of an undesirable thermal condition.

Figure 2:
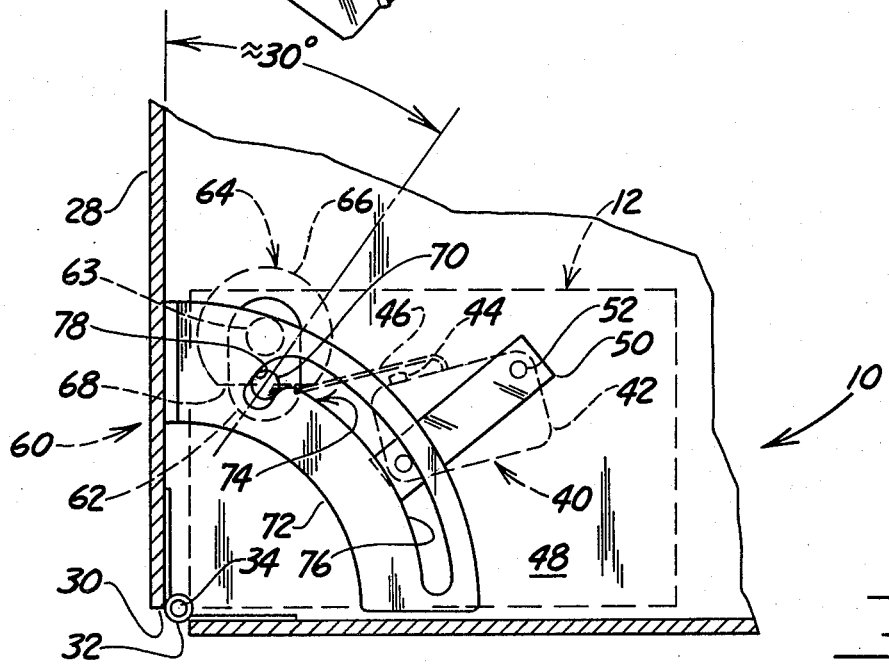
FIG. 2 is a fragmentary side view in elevation of the apparatus of FIG. 1 showing details of the safety control apparatus of FIG. 1 when the door of the machine is in its closed position.

The housing 11 (FIG. 1) has an opening 26 formed therein for manual access into the machine 10, to, for example, repair the aforesaid instrumentalities 14 within the housing 11, and includes a door 28 having its lower end 30 (FIG. 2) suitably pivotably attached to the framework 12, as by means of a hinge 32 having a pivot axis 34. As thus arranged, the door 28 is pivotable between a closed position (FIG. 2) for covering the opening 26 (FIG. 1) and an opened position (FIG. 1) for uncovering the opening 26. To facilitate opening the door 28, the door 28 is provided with a suitable handle, such as a U-shaped notch 36, which extends along the upper end edge 38 of the door 28 for pulling the door open from a location remotely displaced from the hinge axis 34 (FIG. 2).

According to the invention there is provided safety control apparatus for preventing energization of the motor 18 (FIG. 1) whenever the door 28 is open.

The safety control apparatus includes switching means 40 (FIG. 2) which preferably comprises a conventional microswitch having a casing 42, a plunger 44 which is suitably spring loaded to project through an opening (not shown) in the casing 42, and a lever 46 which is connected to the casing 42 on one side of the plunger 44 and extends therefrom so as to overhang and project beyond the casing 42. The switching means 40 is manually inaccessibly located within the machine 10 behind a supporting plate 48 to which the switching means 40 is suitably fixedly attached as by means of a bracket 50 and fasteners 52. As shown in FIG. 4, the switching means 40 preferably includes a normally closed contact 54 electrically connected in series with the motor 18 to permit energization of the motor 18 from the source 20 when the power line switch 22 is closed. For appropriate utilization of contact 54 when the door 28 is in its closed position (FIG. 2), the plunger 44 is in its released position for operation of the switching means 40 in a power-on mode of operation permitting energization of the motor 18 through the closed contact 54 from the source 20. And, when the door 28 is in its opened position (FIG. 3) the plunger 44 is in its depressed position for operation of the switching means 40 in a power-off mode of operation since the open contact 54 prevents energization of the motor 18 from the source 20.

For timely actuating the switching means 40 (FIG. 3) the safety control apparatus includes an actuator 60 comprising an arm 62, having one end suitably pivotably attached to the housing 11 as by means of a shaft 63 extending through the panel 48, and a cam 64 secured to the shaft 63 and thus to the arm 62 for rotation therewith. The cam 64 has a first, curvedly-extending surface 66 which is positionable (FIG. 3) with respect to the lever 46 for depressing the lever 46 and thus the plunger 44 when the door 28 is open; and a second, flat surface 68 which is positionable (FIG. 2) with respect to the lever 46 for releasing the lever 46 and thus the plunger 44 when the door 28 is closed. In addition, the actuator 60 includes a cam follower 70 extending from the other end of the arm 62 for pivoting the arm 62 to rotate the respective cam surfaces, 66 and 68, into appropriate disposition with respect to the lever 46 when the door 28 is opened or closed, as the case may be. As shown in FIG. 2, the cam follower 70 is disposed in a lowered position when the door 28 is closed, which position corresponds to the power-on mode of operation of the switching means 40; and is movable for disposition in a raised position (FIG. 3) when the door is open, which position corresponds to the power-off mode of operation of the switching means 40.

For timely moving the cam follower 70 (FIG. 1) the safety control apparatus includes a bracket 72 suitably fixedly attached to the door 28, for movement therewith. The bracket 72 extends from the door 28 toward and into the housing opening 26, and includes a substantially L-shaped aperture 74 for receiving within the bracket 72, in sliding engagement therewith, the cam follower 70. The aperture 74 (FIG. 3) has a major leg 76 which arcuately extends about the pivot axis 34 of the hinge 32, and thus the door 28, and has a minor leg 78 which curvedly-extends towards the door 28 from the end of the major leg 76 which is adjacent to the door 28. As shown in FIG. 2, when the door 28 is in its closed position, the cam follower 70 is located in the bracket aperture's minor leg 78, which leg 78 extends upwardly towards the major leg 76 and lies in a plane describing an acute angle of approximately 30 degrees or less with respect to the plane of the door 28. With this arrangement the the bracket 72 precipitously cams the cam follower 70 upwardly, within the aperture's minor leg 78, from the lowered position shown in FIG. 2 to the raised position shown in FIG. 3 when the door 28 is initially moved from the closed position of FIG. 2. As hereinbefore discussed this movement of the cam follower 70 pivots the arm 62 to rotate the first cam surface 66 into the position shown in FIG. 3, thereby depressing the lever 46 and plunger 44 for operation of the switching means 40 in its power-off mode of operation. Inasmuch as the aperture's major leg 76 arcuately extends from the minor leg 78 along an arc of a circle having its axis coincident with that of the hinge axis 34, the bracket 72, maintains the cam follower 70 in its raised position within the aperture's major leg 76 after the door 28 is initially opened and as the door 28 is moved to its opened position (FIG. 3) and until the door 28 is thereafter returned to its closed position (FIG. 2). As the door 28 is returned to its closed position the cam follower 70 is cammed downwardly by the bracket 72, within the aperture's minor leg 78, thereby moving the cam follower 70 to its lowered position and pivoting the arm 62 to rotate the second cam surface 68 into the position shown in FIG. 2; as a result of which the lever 46 and plunger 44 are released for operation of the switching means 40 in its power-on mode of operation. Accordingly, upon initially opening and just prior to closing the door 28, the cam follower 70 is positively urged upwardly and downwardly, respectively, to ensure positive control over operation of the switching means 40 in its respective power-off and power-on modes of operation.

Figure 3:
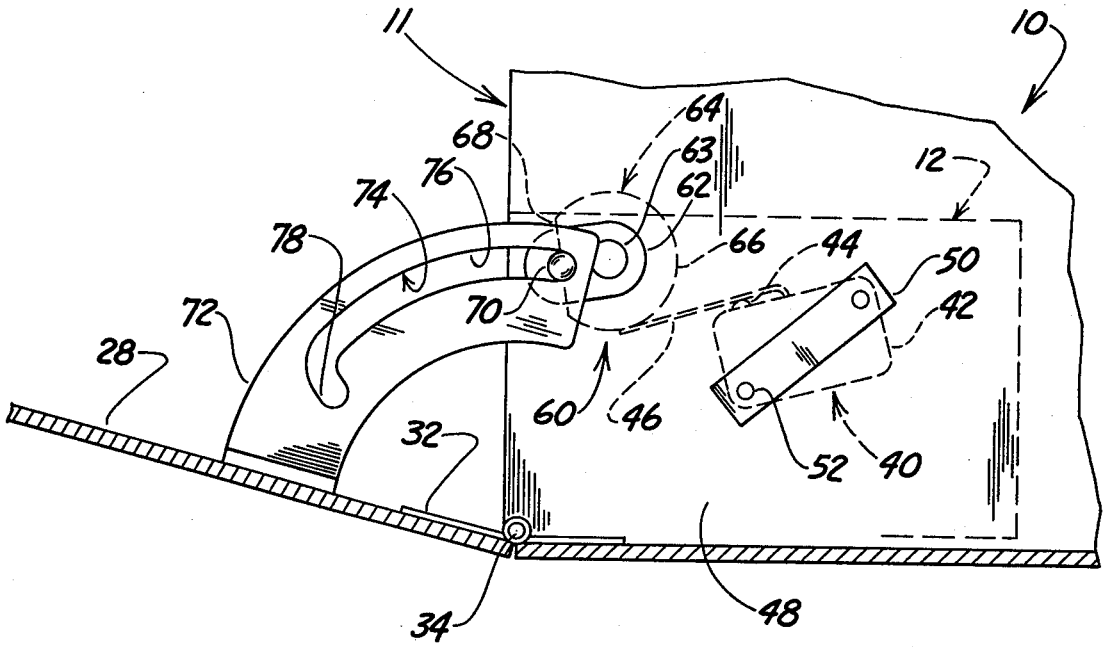
FIG. 3 is a view of FIG. 2 showing details of the safety control apparatus of FIG. 2 showing the same details when the door of the machine is in its opened position.
Figure 4:
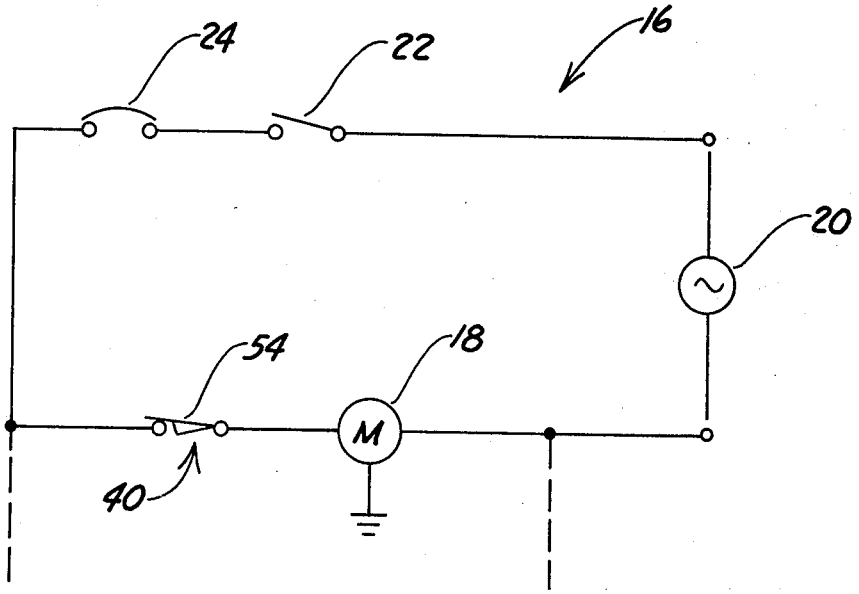
FIG. 4 is a fragmentary schematic view of circuitry for operation of the machine, including the normally closed contact of the switching means of the safety control apparatus according to the invention.

As shown in FIG. 3, when the door 28 is opened the cam follower 70 acts as a stop for the bracket 72 and is cooperative with the bracket 72 for supporting the door 28 in its opened position. Thus the weight of the door 28 holds the cam follower 70 in its raised position, corresponding to the power-off mode of operation of the switching means 40, while the operator is manually accessing the machine 10; thereby preventing inadvertent manual movement of the cam follower 70 and, correspondingly, preventing inadvertent operation of the switching means 40 in its power-on mode of operation.

In accordance with the objects of the invention, there has been described improved safety control apparatus for a machine, including means for deenergizing the motor of the machine upon opening an access door.

Inasmuch as certain changes may be made in the above described invention without departing form the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. In a machine including a motor and a housing, said machine adapted to be connected to a source of supply of power for energizing the motor, said housing having a manually accessible opening formed therein and including a door pivotably movable between a closed position covering said opening and an opened position uncovering said opening, safety control apparatus comprising:

(a) switching means manually inaccessibly mounted within the housing and fixedly attached thereto, said switching means operable in a power-on mode permitting motor energization and a power-off mode preventing motor energization;

(b) means for actuating said switching means, said actuating means pivotably attached to said housing and disposed in engagement with said switching means, said actuating means including a cam follower movable between a first position wherein said actuating means is disposed for operation of said switching means in said power-on mode and a second position wherein said actuating means is disposed for operation of said switching means in said power-off mode; and (c) a bracket fixedly attached to the door for movement therewith, said bracket including a substantially L-shaped aperture for receiving within the bracket in sliding engagement therewith said cam follower, said aperture including one leg adapting said bracket for precipitously camming said cam follower from said first position to said second position in response to initial opening movement of said door, and said aperture including another leg thereof arcuately extending from said first leg and adapting said bracket for maintaining said cam follower in said second position against inadvertent manual movement thereof as said door is moved to and from said opened position and until just prior to said door being thereafter closed, whereby said switching means operates in said power-on mode whenever said door is closed and is maintained in said power-off mode whenever said door is open.

2. The apparatus according to claim 1, wherein said cam follower acts as a stop cooperating with said bracket for supporting said door in said opened position.

3. The apparatus according to claim 1, wherein said aperture adapts said bracket for camming said cam follower from said second position to said first position just prior to said door being closed.

4. The apparatus according to claim 1, wherein said another leg of said aperture arcuately extends about the pivot axis of said door.

5. The apparatus according to claim 1, wherein said switching means includes a plunger and a lever, said lever overhanging the plunger, said actuating means including a cam disposed in engagement with said lever for movement thereof, said cam including a first surface for depressing said lever and thus said plunger for operation of said switching means in one of said modes of operation, and said cam including a second surface for releasing said depressed lever and thus said plunger for operation of said switching means in the other of said modes of operation.

6. The apparatus according to claim 1, wherein said actuating means includes a rotatable cam having first and second surfaces corresponding to said first and second positions of said cam follower, said cam continuously disposed in engagement with said switching means, said actuating means including an arm pivotably attached to said housing and having said cam secured thereto for rotation therewith, said cam follower connected to said arm for movement thereof when said cam follower is moved between said first and second positions, whereby said movement results in said cam being rotated for appropriate disposition of said cam surfaces with respect to said switching means for operation thereof.

* * * * *